US010221728B2

(12) United States Patent
Suzuki et al.

(10) Patent No.: US 10,221,728 B2
(45) Date of Patent: Mar. 5, 2019

(54) VARIABLE VALVE MECHANISM OF INTERNAL COMBUSTION ENGINE

(71) Applicant: OTICS CORPORATION, Nishio-shi (JP)

(72) Inventors: Hiroyuki Suzuki, Nishio (JP); Akira Sugiura, Nishio (JP); Koki Yamaguchi, Nishio (JP)

(73) Assignee: OTICS CORPORATION, Nishio-Shi, Aichi-Ken (JP)

( * ) Notice: Subject to any disclaimer, the term of this patent is extended or adjusted under 35 U.S.C. 154(b) by 145 days.

(21) Appl. No.: 15/480,857

(22) Filed: Apr. 6, 2017

(65) Prior Publication Data

US 2017/0350282 A1 Dec. 7, 2017

(30) Foreign Application Priority Data

Jun. 2, 2016 (JP) ..... 2016-110735

(51) Int. Cl.
*F01L 1/34* (2006.01)
*F01L 1/24* (2006.01)
*F01L 1/46* (2006.01)

(52) U.S. Cl.
CPC ..... *F01L 1/24* (2013.01); *F01L 1/462* (2013.01); *F01L 2105/00* (2013.01)

(58) Field of Classification Search
CPC ..... F01L 1/24; F01L 1/462; F01L 2105/00
See application file for complete search history.

(56) References Cited

U.S. PATENT DOCUMENTS

2008/0295789 A1* 12/2008 Manther ..... F01L 1/185 123/90.45
2014/0290608 A1 10/2014 Radulescu
2015/0275712 A1 10/2015 Manther

* cited by examiner

*Primary Examiner* — Zelalem Eshete
(74) *Attorney, Agent, or Firm* — McGinn IP Law Group, PLLC.

(57) ABSTRACT

A variable valve mechanism includes an input arm that axially supports a roller pressed by a cam, via a roller pin, an output arm that drives a valve when swinging, a switch device that switches the variable valve mechanism between a coupled state where the both arms are coupled and an uncoupled state where the arms are uncoupled from each other, and a lost motion spring that biases the roller against the cam when in the uncoupled state. The lost motion spring includes an extended portion extending in an inter-arm clearance between the input arm and the output arm. An end of the roller pin projects from the input arm into the inter-arm clearance by such a length that the end is accommodated in the inter-arm clearance and that allows a spring retaining portion to be formed in the end. The spring retaining portion is formed in the end.

12 Claims, 13 Drawing Sheets

VARIABLE VALVE MECHANISM OF INTERNAL COMBUSTION ENGINE

TECHNICAL FIELD

The present invention relates to variable valve mechanisms that drive a valve of an internal combustion engine and change the drive state of the valve according to the operating condition of the internal combustion engine.

BACKGROUND ART

A variable valve mechanism 90A of a first conventional example shown in FIG. 13A and a variable valve mechanism 90B of a second conventional example shown in FIG. 13B switch between a coupled state where an input arm 92 and an output arm 93 are coupled together and an uncoupled state where the input arm 92 and the output arm 93 are uncoupled from each other. Each variable valve mechanism 90A, 90B includes lost motion springs 95 that bias the input arm 92 against a cam when the variable valve mechanism 90A, 90B is in the uncoupled state.

Specifically, in the variable valve mechanism 90A of the first conventional example (Patent Document 1) shown in FIG. 13A, the output arm 93 (outer arm) has slot holes 93*a*. A roller pin 97 is attached to the input arm 92 (inner arm) to axially support a roller 98. The roller pin 97 extends from the input arm 92 and through the slot holes 93*a* and projects laterally from the output arm 93. The roller pin 97 has spring retaining portions 97*a* in the projecting portions thereof, and extended portions 95*a* of the lost motion springs 95 are retained on the spring retaining portions 97*a*.

In the variable valve mechanism 90B of the second conventional example (Patent Document 2) shown in FIG. 13B, extended portions 95*b* of the lost motion springs 95 are located in inter-arm clearances g between the input arm 92 (inner arm) and the output arm 93 (outer arm). Spring retaining portions 92*b* on which the extended portions 95*b* of the lost motion springs 95 are retained are formed in the upper part of the input arm 92 so as to extend in the inter-arm clearances g and project upward from the inter-arm clearances g.

CITATION LIST

Patent Document

[Patent Document 1] US Patent Application Publication No. 2014/0290608

[Patent Document 2] US Patent Application Publication No. 2015/0275712

SUMMARY OF INVENTION

Technical Problem

In the variable valve mechanism 90A of the first conventional example shown in FIG. 13A, the output arm 93 has the slot holes 93*a*. The output arm 93 therefore has a complicated shape, which reduces design flexibility in terms of the shape of the output arm 93.

In the variable valve mechanism 90B of the second conventional example shown in FIG. 13B, the slot holes 93*a* need not be formed. However, the variable valve mechanism 90B has the following problems.

First, the input arm 92 has the spring retaining portions 92*b* formed in its upper part so as to project into the inter-arm clearances g. Accordingly, no shapes that project into the inter-arm clearances g (such as slippers 93*b* that are in sliding contact with second cams) can be formed in the upper part of the output arm 93 at positions overlapping the spring retaining portions 92*b*. Such shapes (such as the slippers 93*b*) therefore need be formed in regions that do not overlap the spring retaining portions 92*b*, which reduces design flexibility in terms of the shape of the output arm 93.

Second, since the input arm 92 has the spring retaining portions 92*b*, the input arm 92 has a complicated shape, which reduces design flexibility in terms of the shape of the input arm 92. The input arm 92 having such a complicated shape leads to an increase in manufacturing cost.

Third, the inter-arm clearances g are narrow, and the ends of a roller pin (not shown) axially supporting the roller 98, structures that fix the roller pin to the input arm 92, etc. need be disposed in the inter-arm clearances g. Accordingly, only limited space in each inter-arm clearance g is available for the extended portion 95*b* of the lost motion spring and the spring retaining portion 92*b*, which reduces design flexibility in terms of the positions, forms, etc. of the lost motion springs 95 and the spring retaining portions 92*b*. Due to such reduced design flexibility in terms of the forms, it is difficult to design the variable valve mechanism 90B with a large contact area between the extended portion 95*b* of the lost motion spring and the spring retaining portion 92*b*. This results in a large surface pressure between the extended portion 95*b* of the lost motion spring and the spring retaining portion 92*b*, increasing wear therebetween.

Fourth, the biasing force of the lost motion springs 95 is transmitted from the spring retaining portions 92*b* to the roller pin (not shown) and the roller 98 via the input arm 92. This causes wear between the input arm 92 and the roller pin.

It is an object of the present invention to solve the above first to fourth problems without forming slot holes in an output arm.

Solution to Problem

In order to achieve the above object, a variable valve mechanism of an internal combustion engine according to the present invention is configured as follows. The variable valve mechanism of an internal combustion engine includes an input arm that axially supports a roller, which is pressed by a cam, via a roller pin, an output arm that drives a valve when swinging, a switch device that switches the variable valve mechanism between a coupled state where the input arm and the output arm are coupled to swing together and an uncoupled state where the input arm and the output arm are uncoupled from each other, and a lost motion spring that presses a spring retaining portion, which swings with the input arm, to bias the roller against the cam when in the uncoupled state.

The variable valve mechanism has the following characteristics when in a base circle phase during which a base circle of the cam functions. There is an inter-arm clearance between the input arm and the output arm. The lost motion spring includes an extended portion that extends in the inter-arm clearance and that presses the spring retaining portion. An end of the roller pin projects from the input arm into the inter-arm clearance by such a length that the end is accommodated in the inter-arm clearance and that allows the spring retaining portion to be formed in the end. The spring retaining portion is formed in the end.

Advantageous Effects of Invention

According to the present invention, the spring retaining portion is located in the inter-arm clearance and does not project laterally from the output arm. Accordingly, such a slot hole as in the first conventional example need not be formed in the output arm.

The spring retaining portion is formed in the roller pin rather than in the upper part of the input arm. Accordingly, even if a shape that projects into the inter-arm clearance (such as a slipper that is in sliding contact with a second cam) is formed in the upper part of the output arm, such a shape does not contact the spring retaining portion. This increases design flexibility in terms of the shape of the output arm, and thus solves the first problem.

The spring retaining portion is formed in the roller pin rather than in the input arm. This simplifies the shape of the input arm and increases design flexibility in terms of the shape of the input arm. Due to the simplified shape of the input arm, reduction in manufacturing cost is also expected. This solves the second problem.

The spring retaining portion is formed in the end of the roller pin rather than in the upper part of the input arm where only limited space is available. This increases space available for the spring retaining portion and thus increases design flexibility in terms of the positions, forms, etc. of the spring retaining portion and the lost motion spring. Due to the increased design flexibility in terms of the forms, it is easier to increase the contact area between the lost motion spring and the spring retaining portion. A surface pressure between the lost motion spring and the spring retaining portion can thus be reduced, whereby wear therebetween can be reduced. This solves the third problem.

Since the spring retaining portion is formed in the roller pin, the biasing force of the lost motion spring is transmitted directly to the roller pin without via the input arm. This reduces wear between the input arm and the roller pin and thus solves the fourth problem.

DESCRIPTION OF EMBODIMENTS

Figure 1:
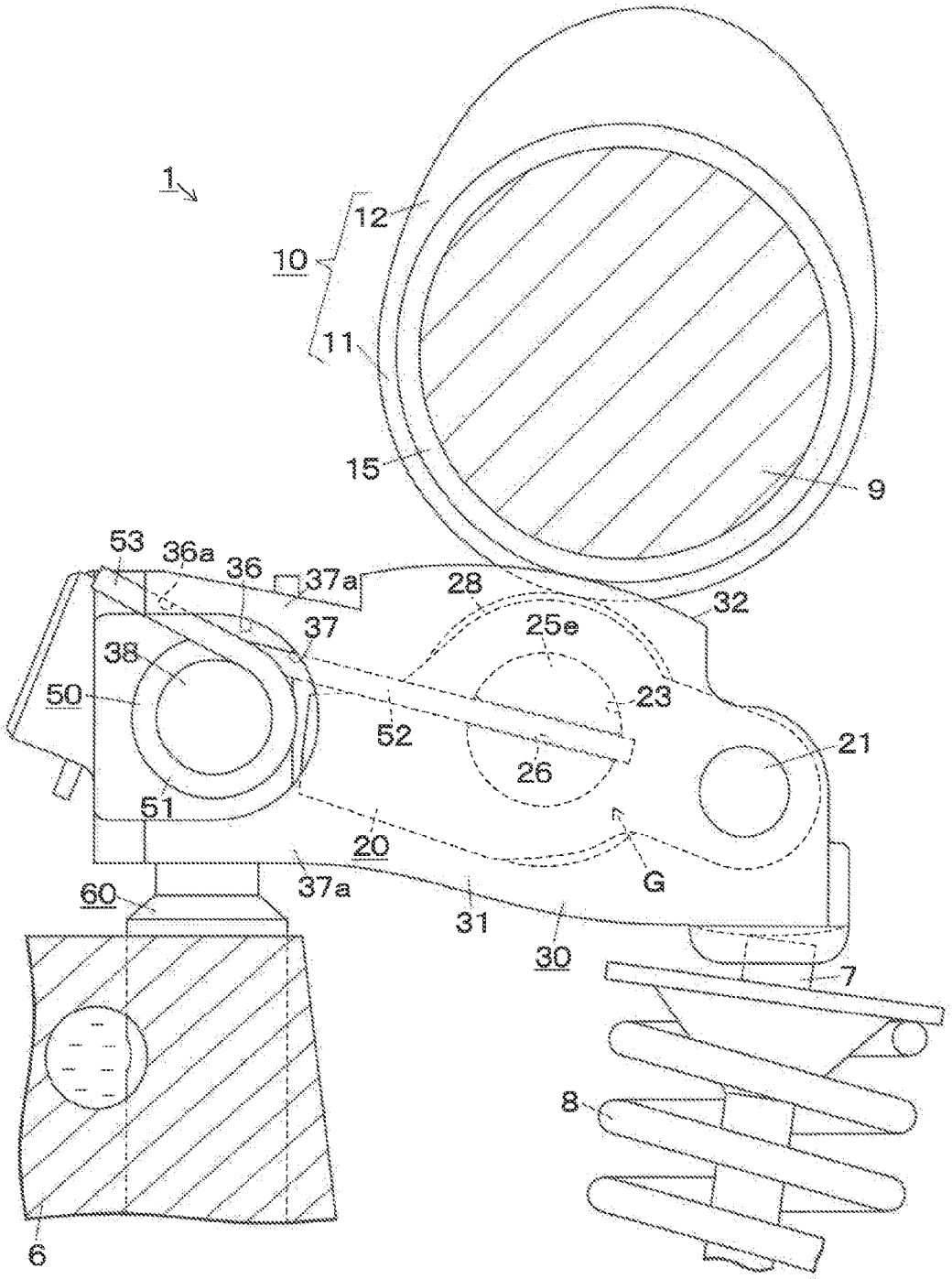
FIG. 1 is a side view of a variable valve mechanism of a first embodiment.

The roller pin may be fixed to the input arm. However, it is preferable that the roller pin be attached to the input arm so that the roller pin can rotate relative to the input arm. It is preferable that, as the input arm swings relative to the output arm, the roller pin rotate relative to the input arm accordingly. Since the spring retaining portion formed in the end of the roller pin rotates, wear between the extended portion of the lost motion spring and the spring retaining portion is reduced.

The roller pin may rotate relative to the input arm in the following manners, although the present invention is not limited to these.

(i) The spring retaining portion is long in a radial direction of the roller pin. When in the uncoupled state, as the input arm swings relative to the output arm, a longitudinal direction of the spring retaining portion is shifted accordingly so as to align with a longitudinal direction of the extended portion of the lost motion spring, whereby the roller pin rotates relative to the input arm.

(ii) The spring retaining portion is long in a circumferential direction of the roller pin. When in the uncoupled state, as the input arm swings relative to the output arm, the spring retaining portion rolls on the extended portion of the lost motion spring accordingly, whereby the roller pin rotates relative to the input arm.

The spring retaining portion may be in the form of a groove, a recess, a hole, a projection, etc. Specific forms of the spring retaining portions are shown below, although the present invention is not limited to these.

(A) The spring retaining portion is an end face groove formed in an end face of the roller pin so as to extend in the radial direction.

(B) The spring retaining portion is a through hole formed in the end of the roller pin so as to extend through the roller pin in the radial direction.

(C) The spring retaining portion is an outer peripheral groove formed in an outer peripheral surface of the end of the roller pin so as to extend in the circumferential direction.

The output arm may not have a slipper that is in sliding contact with a camshaft etc. However, it is preferable that the output arm have a slipper in order to take more advantage of the effect of the solution to the first problem. Specifically, it is preferable that the cam be disposed on a camshaft so as to project therefrom and the output arm have a slipper that is in sliding contact with the camshaft or a second cam disposed on the camshaft so as to project therefrom.

The form of the output arm is not particularly limited. However, it is preferable that an insertion hole extending from a position outside the inter-arm clearance to a position in the inter-arm clearance be formed so as to extend through an intermediate portion in a vertical direction of the output arm with a connecting portion remaining on both sides in the vertical direction of the insertion hole, and the extended portion of the lost motion spring be inserted through the insertion hole. Since the insertion hole is formed with the connecting portion remaining on both sides in the vertical direction of the insertion hole, higher strength is achieved as compared to the case where only one side in the vertical direction is connected (as in the second conventional example etc.).

[First Embodiment]

Embodiments of the present invention will be described below. However, the present invention is not limited to the embodiments and the configuration and shape of each part can be modified as appropriate without departing from the spirit and scope of the invention.

A variable valve mechanism 1 of a first embodiment shown in FIGS. 1 to 7C periodically presses an intake or exhaust valve 7 provided with a valve spring 8 to open and close the valve 7. The variable valve mechanism 1 includes a cam 10, an input arm 20, an output arm 30, a switch device 40, and lost motion springs 50.

[Cam 10]

The cam 10 shown in FIG. 1 etc. is disposed on a camshaft 9. The camshaft 9 makes one full rotation for every two full rotations of an internal combustion engine, and the cam 10 rotates with the camshaft 9. Hereinafter, the longitudinal direction of the camshaft 9 is referred to as the lateral direction, and the horizontal direction perpendicular to the longitudinal direction of the camshaft 9 is referred to as a front-rear direction. The cam 10 includes a base circle 11 having a circular section and a nose 12 projecting from the base circle 11. In the above section "BRIEF DESCRIPTION OF DRAWINGS" and the following description, the "base circle phase" refers to a period during which the base circle 11 of the cam 10 functions and the "nose phase" refers to a period during which the nose 12 of the cam 10 functions. Second cams 15 (no-lift cams) having a circular section are disposed on the right and left sides of the cam 10 on the camshaft 9.

[Input Arm 20]

Figure 5A:
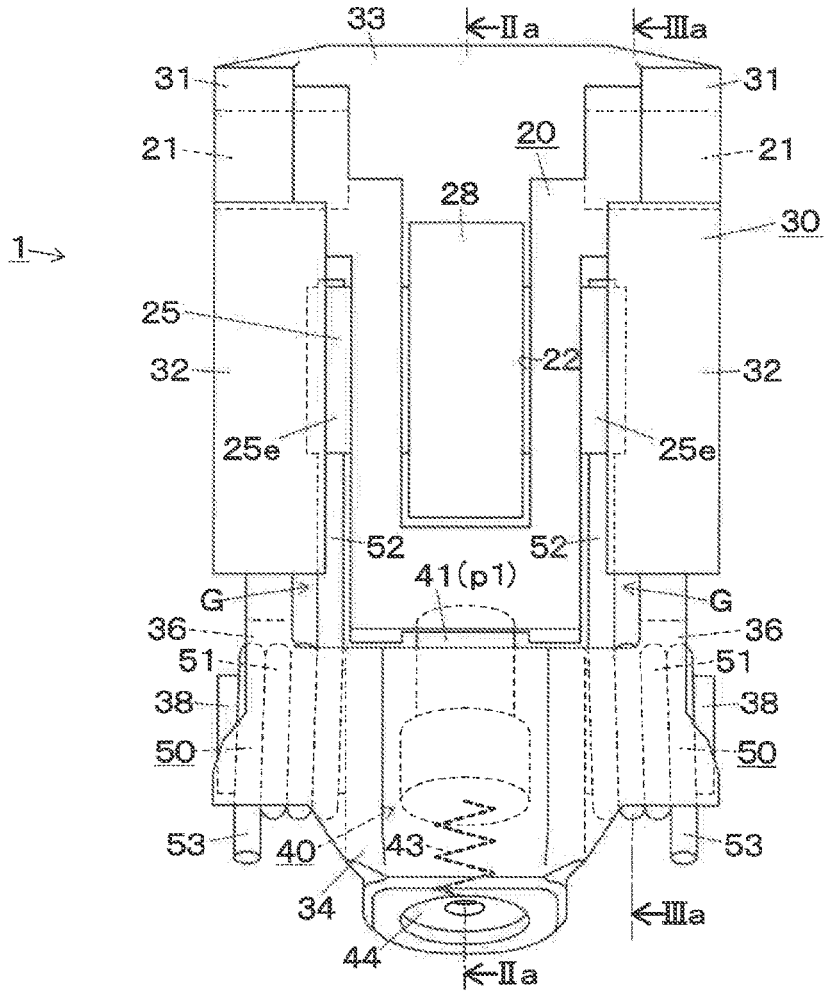
FIG. 5A is a plan view showing arms of the variable valve mechanism of the first embodiment.
Figure 5B:
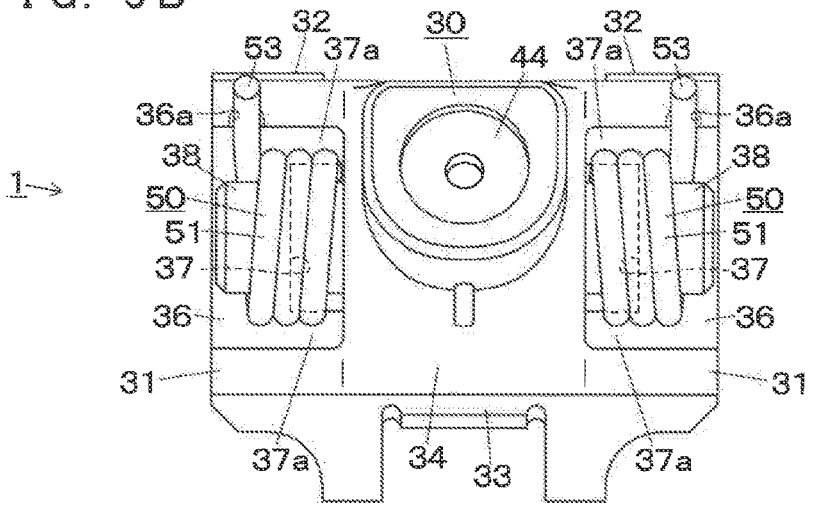
FIG. 5B is a rear view showing the arms of the variable valve mechanism of the first embodiment.
Figure 6A:
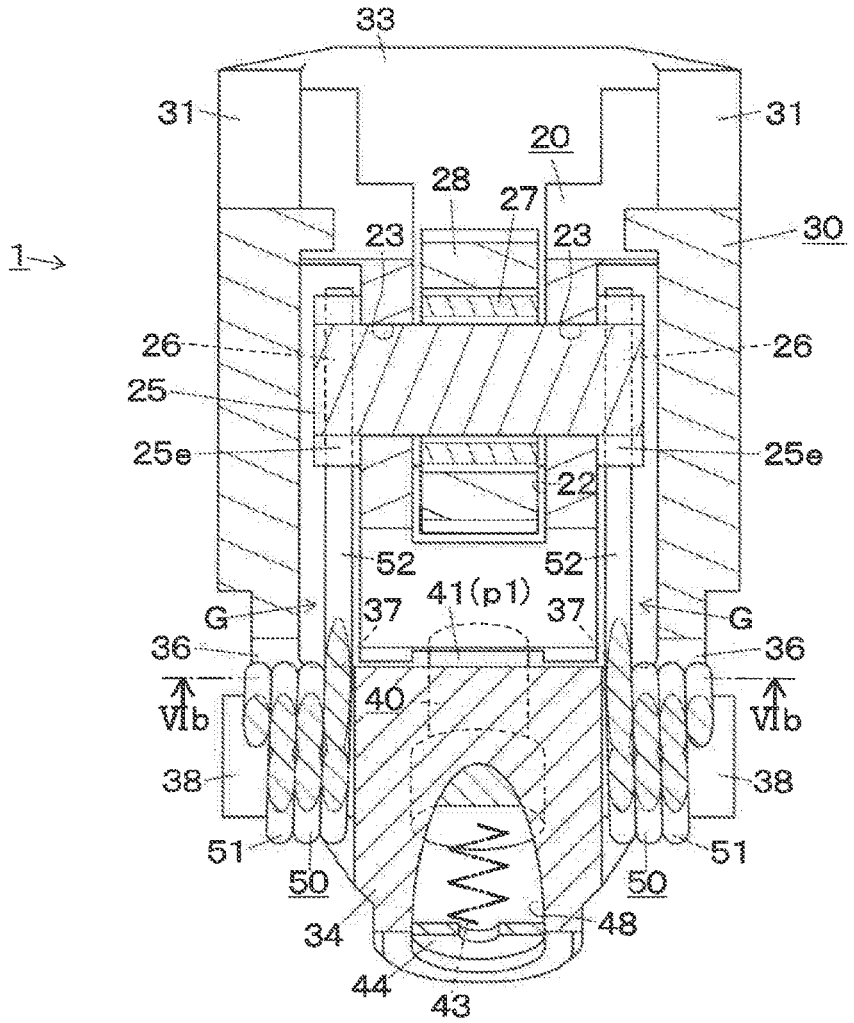
FIG. 6A is a sectional plan view (taken along line VIa-VIa in FIG. 6B) showing arms of the variable valve mechanism of the first embodiment.

As shown in FIG. 5A etc., the input arm 20 is an inner arm disposed inside the output arm 30 in the lateral direction. A front end of the input arm 20 is relatively swingably coupled to a front end of the output arm 30 by shaft members 21. When in a base circle phase shown in FIGS. 5A, 5B, etc., there is an inter-arm clearance G between each of the right and left side surfaces of the input arm 20 (inner arm) and each of the inner side surfaces of the output arm 30 (outer arm) which face the right and left side surfaces of the input arm 20 (inner arm) in the lateral direction. A roller attachment portion 22 is formed in an intermediate portion in the lateral direction of the input arm 20. The roller attachment portion 22 is in the form of a recess that opens forward, upward, and downward. As shown in FIG. 6A etc., the input arm 20 has support holes 23. The support holes 23 extend through the side surfaces of the input arm 20 to the roller attachment portion 22. A roller 28 is rotatably and axially supported in the roller attachment portion 22 via a roller pin 25 and a bearing 27. As shown in FIG. 1 etc., the roller 28 is in contact with the cam 10 and is pressed by the cam 10.

Figure 7A:
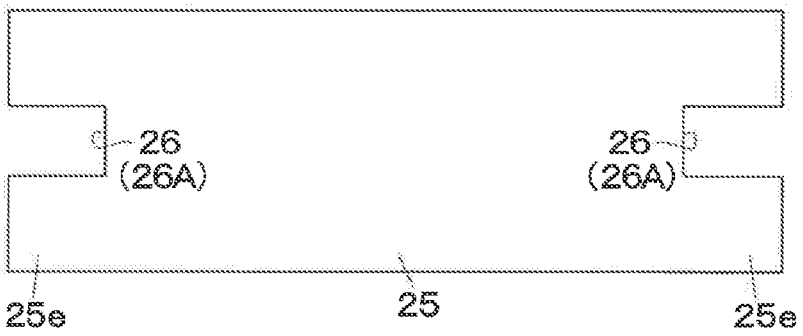
FIG. 7A is a front view of a roller pin of the variable valve mechanism of the first embodiment.
Figure 7B:
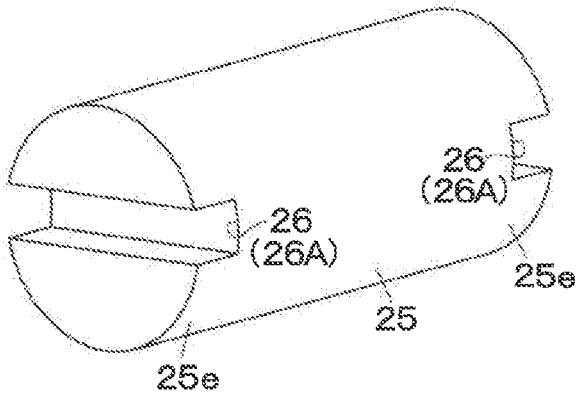
FIG. 7B is a perspective view of the roller pin of the variable valve mechanism of the first embodiment.
Figure 7C:
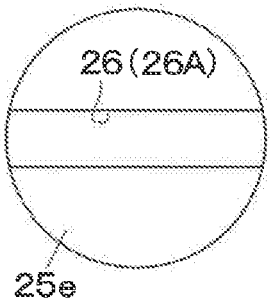
FIG. 7C is a side view of the roller pin of the variable valve mechanism of the first embodiment.
Figure 8B:
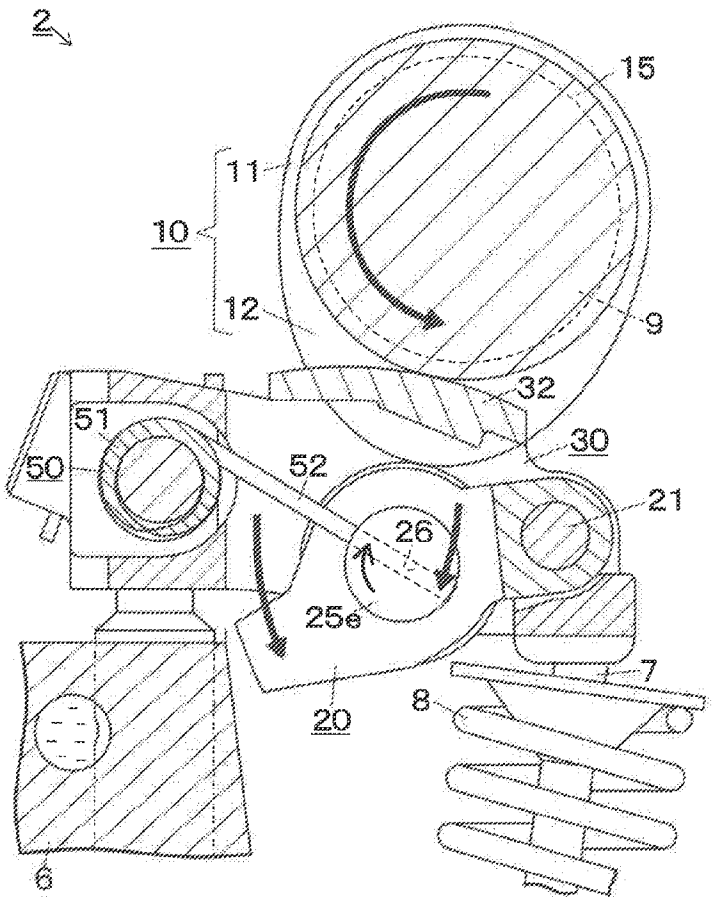
FIG. 8B is a side sectional view showing a nose phase of the variable valve mechanism of the second embodiment in the uncoupled state.
Figure 8A:
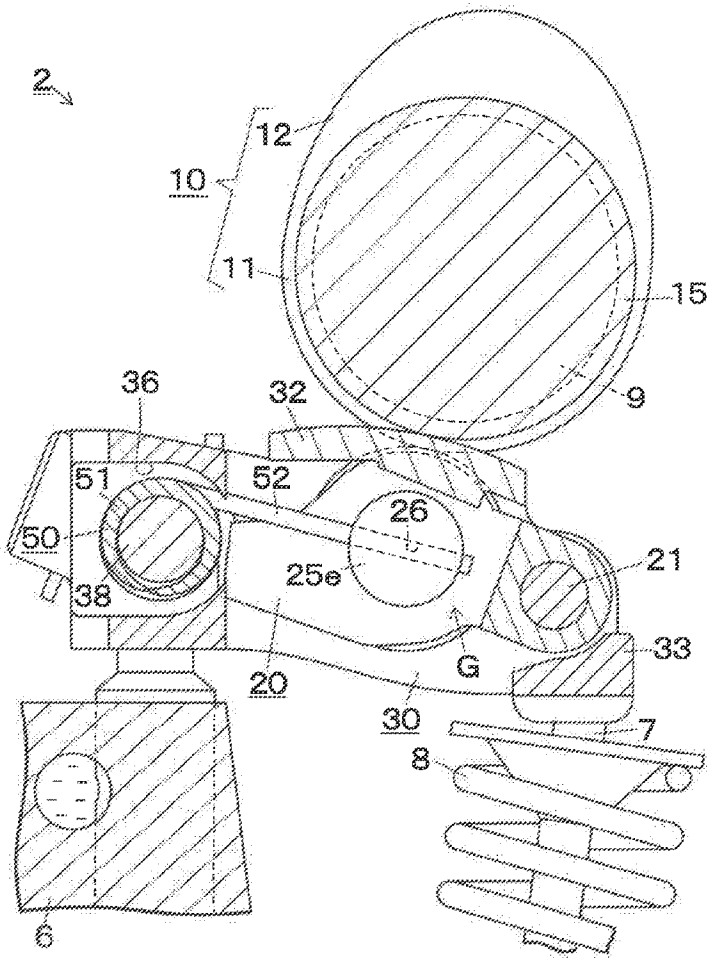
FIG. 8A is a side sectional view showing a base circle phase of a variable valve mechanism of a second embodiment in an uncoupled state.

Specifically, as shown in FIGS. 7A to 7C etc., the roller pin 25 is a columnar member extending in the lateral direction. As shown in FIG. 6A etc., those parts of the roller pin 25 which are located inside its right and left ends 25*e* extend through the support holes 23. The roller pin 25 is thus relatively rotatably supported by the input arm 20. When in a base circle phase shown in FIG. 6A etc., each of the right and left ends 25*e* of the roller pin 25 projects from the input arm 20 into a corresponding one of the inter-arm clearances G by such a length that the end 25*e* is accommodated in the inter-arm clearance G and that allows a spring retaining portion 26 to be formed in the end 25*e*. The spring retaining portions 26 are formed in the ends 25*e*. As shown in FIGS. 7A to 7C etc., in the first embodiment, the spring retaining portions 26 are end face grooves 26A formed in end faces of the roller pin 25 so as to extend in the radial direction.

[Output Arm 30]

Figure 2A:
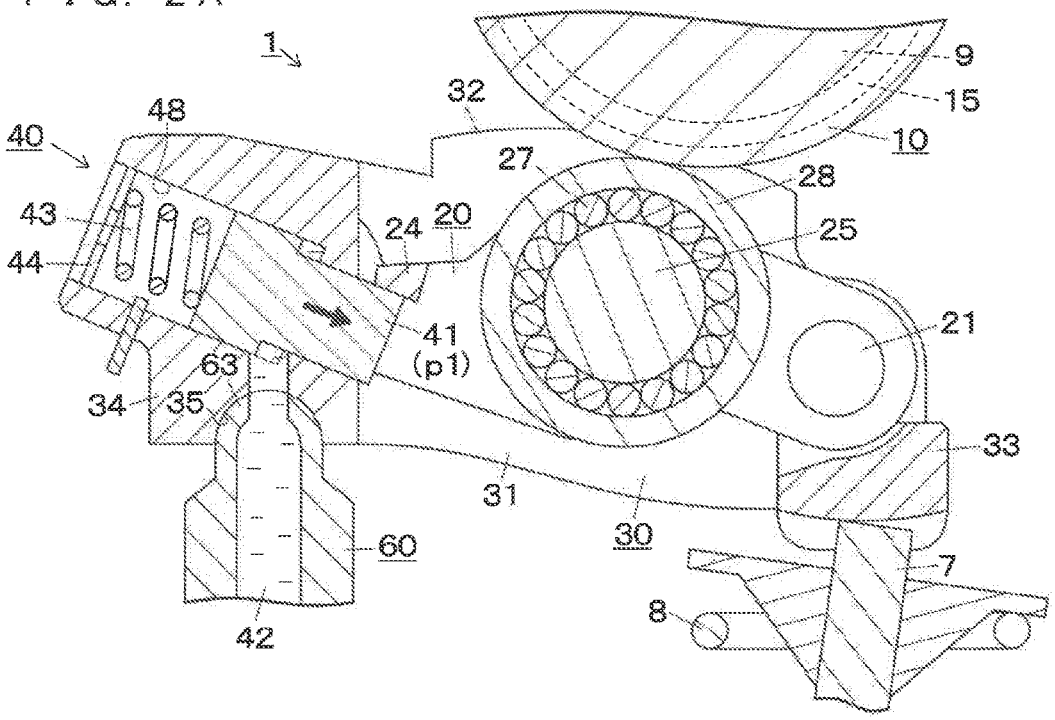
FIG. 2A is a side sectional view (taken along line IIa-IIa in FIG. 5A) of the variable valve mechanism of the first embodiment switched to a coupled state.
Figure 2B:
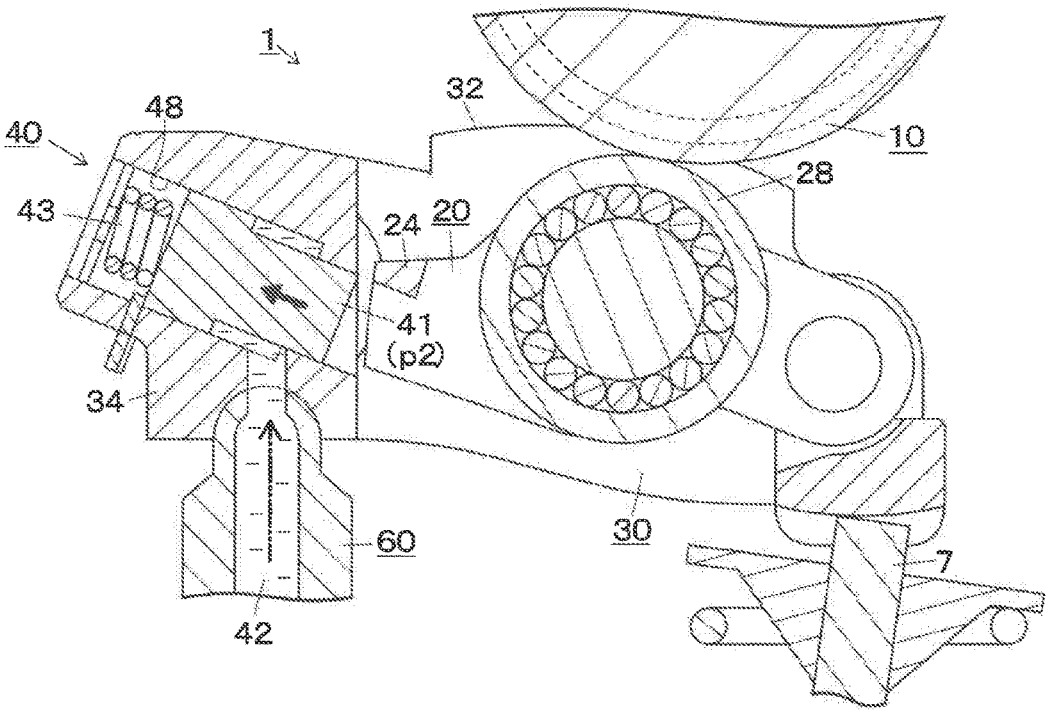
FIG. 2B is a side sectional view of the variable valve mechanism of the first embodiment switched to an uncoupled state.
Figure 3B:
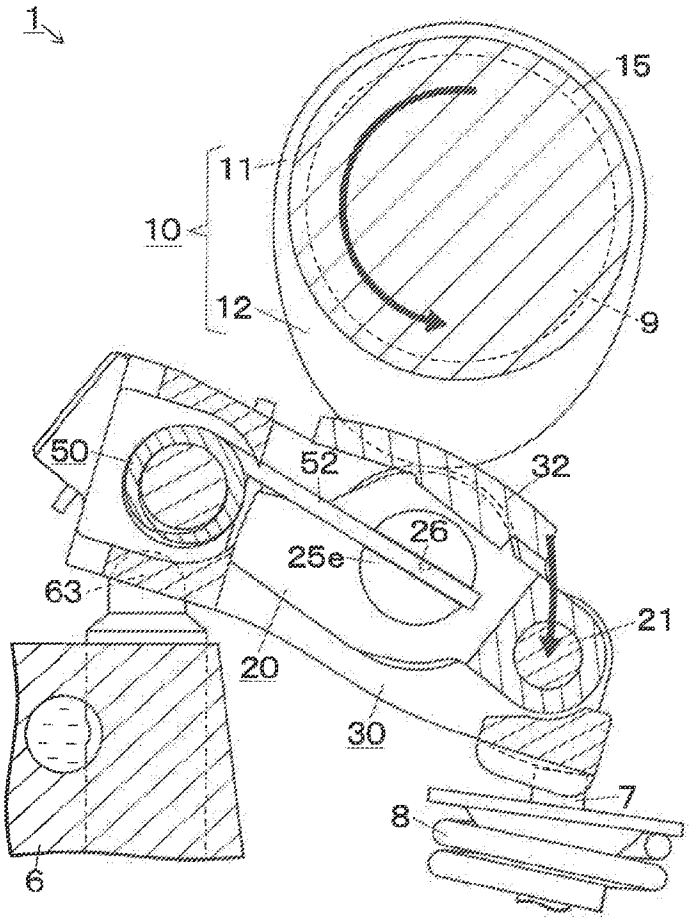
FIG. 3B is a side sectional view showing a nose phase of the variable valve mechanism of the first embodiment in the coupled state.
Figure 3A:
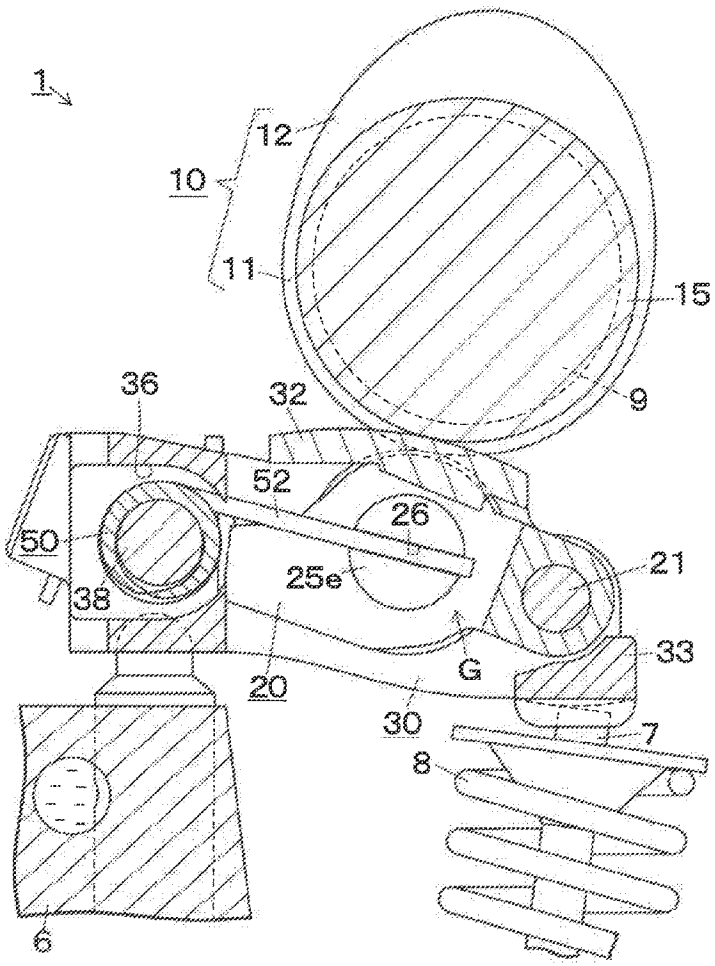
FIG. 3A is a side sectional view (taken along line IIIa-IIIa in FIG. 5A) showing a base circle phase of the variable valve mechanism of the first embodiment in the coupled state.

As shown in FIG. 5A etc., the output arm 30 is an outer arm disposed outside the input arm 20 in the lateral direction. Specifically, the output arm 30 is formed by side plate portions 31 disposed on the right and left sides relative to the input arm 20 such that one side plate portion 31 is located on each side relative to the input arm 20, and a base portion 34 connecting rear ends of the right and left side plate portions 31. The output arm 30 thus has a U-shape opening forward, and the input arm 20 is disposed inside the U-shape. As shown in FIGS. 2A, 2B, etc., the output arm 30 is swingably supported by a hemispherical portion 63 that is the upper end of a pivot 60 at a hemispherical recess 35 that is a recess provided in the lower surface of the base portion 34. Lower ends of front ends of the right and left side plate portions 31 are connected by a bridge portion 33. The bridge portion 33 is in contact with a stem end of the valve 7. As shown in FIGS. 3A, 3B, etc., the right and left side plate portions 31 have, in their upper ends, slippers 32 that are in sliding contact with the second cams 15. As shown in FIG. 5A etc., the slippers 32 project into the inter-arm clearances G.

Figure 6B:
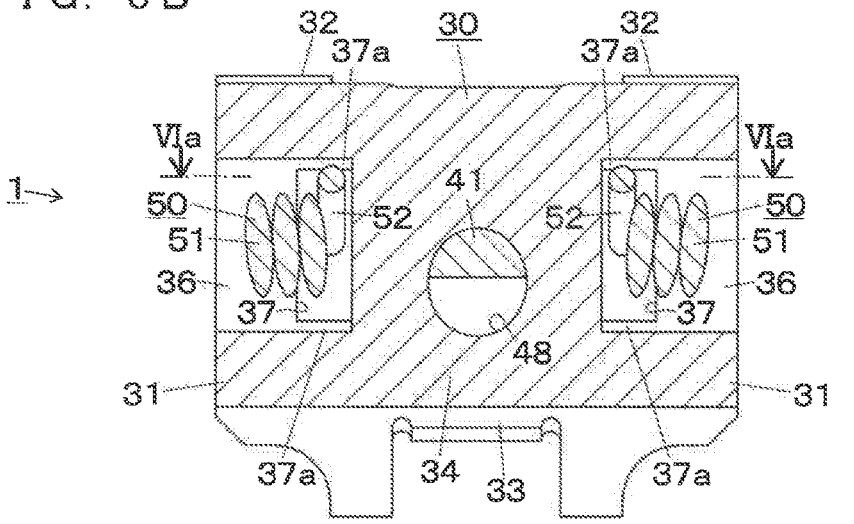
FIG. 6B is a rear sectional view (taken along line VIb-VIb in FIG. 6A) showing the arms of the variable valve mechanism of the first embodiment.

As shown in FIGS. 6A, 6B, etc., a left storage portion 36 is formed so as to extend in both the left side plate portion 31 and the base portion 34, and a right storage portion 36 is formed so as to extend in both the right side plate portion 31 and the base portion 34. Specifically, the right storage portion 36 opens both outward to the right and rearward and the left storage portion 36 opens both outward to the left and rearward. Apart of the front side of each storage portion 36 extends through the output arm 30 to a corresponding one of the inter-arm clearances G. This part extending through the output arm 30 forms an insertion hole 37. Each insertion hole 37 is thus formed so as to extend through an intermediate portion in the vertical direction of the output arm 30 with a connecting portion 37*a* remaining on both sides in the vertical direction of the insertion hole 37. Each insertion hole 37 is a hole through which an extended portion 52 of a corresponding one of the lost motion springs 50 is inserted so as to allow the extended portion 52 to swing. A projection 38 is formed in each of the right and left storage portions 36, and a coil portion 51 of a corresponding one of the lost motion springs 50 is fitted on each projection 38. The projection 38 in the right storage portion 36 projects outward to the right from the left inner wall of the right storage portion 36, and the projection 38 in the left storage portion 36 projects outward to the left from the right inner wall of the left storage portion 36.

[Switch Device 40]

Figure 4B:
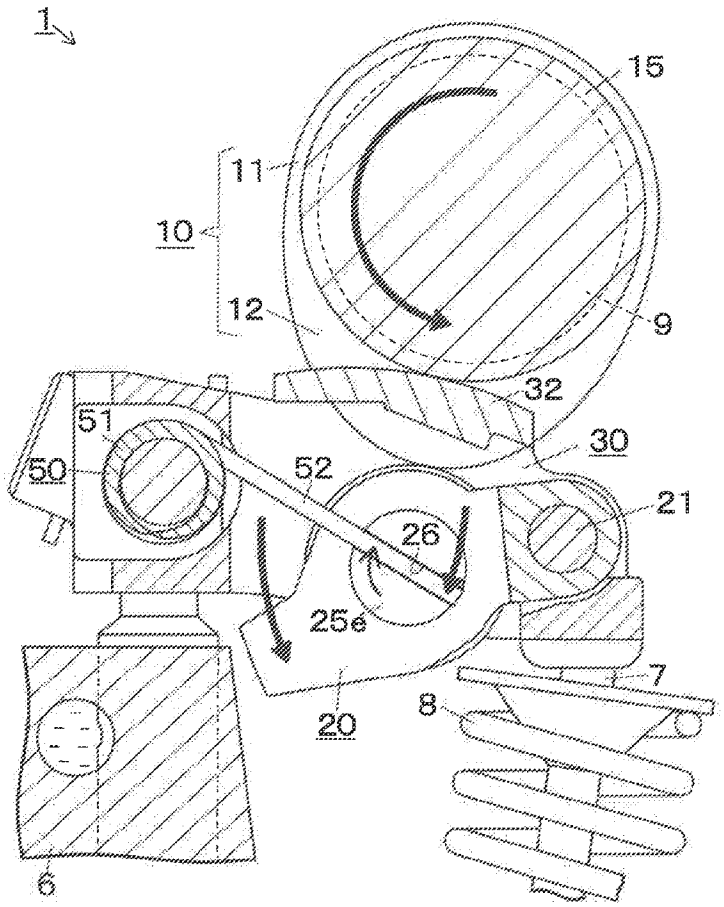
FIG. 4B is a side sectional view showing a nose phase of the variable valve mechanism of the first embodiment in the uncoupled state.
Figure 4A:
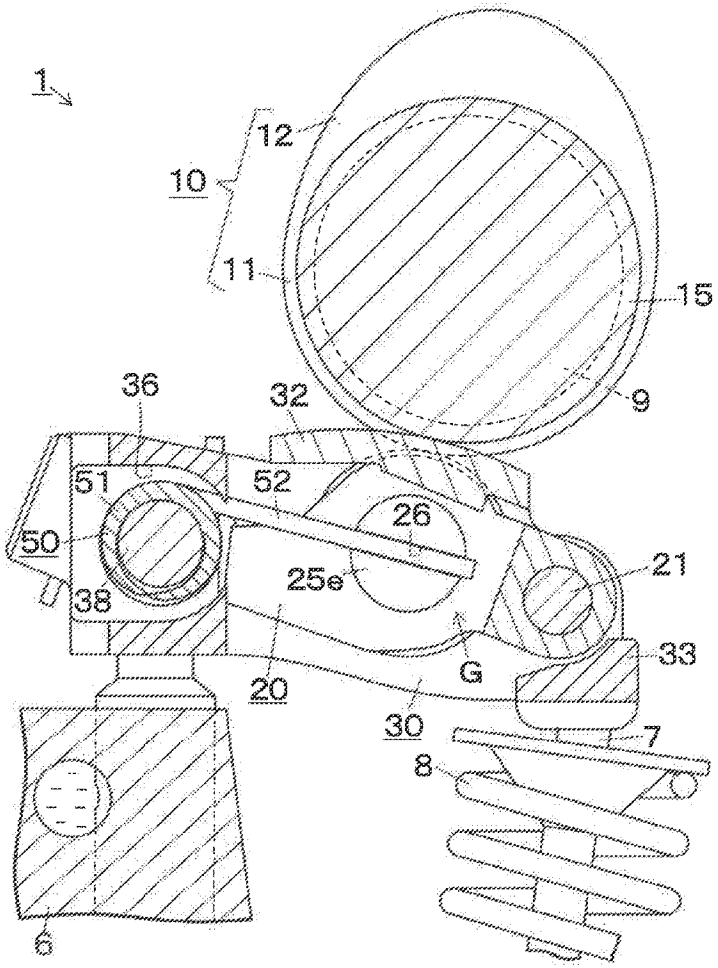
FIG. 4A is a side sectional view showing a base circle phase of the variable valve mechanism of the first embodiment in the uncoupled state.

The switch device 40 shown in FIGS. 2A, 2B, etc. includes a switch pin 41, an oil pressure path 42, and a spring 43. The output arm 30 has a pin hole 48 formed in the middle in the lateral direction of the base portion 34 so as to extend through the base portion 34 in the front-rear direction. The switch pin 41 is fitted in the pin hole 48 and can be shifted between a front position and a rear position, namely between a coupled position p1 and an uncoupled position p2. As shown in FIG. 2A etc., the front position, namely the coupled position p1, is such a position that a front end of the switch pin 41 projects forward from the base portion 34 and is located under a rear end 24 of the input arm 20. As shown in FIGS. 3A and 3B, when the switch pin 41 is shifted to the coupled position p1, the input arm 20 and the output arm 30 swing together about the hemispherical portion 63 of the pivot 60 to drive the valve 7. As shown in FIG. 2B etc., the rear position, namely the uncoupled position p2, is such a position that the front end of the switch pin 41 is withdrawn into the base portion 34 and is not located under the rear end 24 of the input arm 20. As shown in FIGS. 4A and 4B, when the switch pin 41 is shifted to the uncoupled position p2, the input arm 20 swings (swings in an idle manner) relative to the output arm 30 about the shaft members 21, whereby driving of the valve 7 is stopped.

The oil pressure path 42 shown in FIGS. 2A, 2B, etc. is a path through which an oil pressure that shifts the switch pin 41 to the rear position, namely the uncoupled position p2, is supplied. This oil pressure path 42 extends from a cylinder head 6 through the pivot 60 into the pin hole 48 of the output arm 30. As shown in FIG. 2B etc., when in the uncoupled state, an oil pressure is applied rearward to the switch pin 41. The spring 43 is a member that shifts the switch pin 41 to the front position, namely the coupled position p1, as shown in FIG. 2A etc. when the oil pressure in the oil pressure path 42 drops. The spring 43 is placed behind the switch pin 41 in the pin hole 48. A retainer 44 is fitted in the pin hole 48 at a position near a rear end of the pin hole 48 and retains a rear end of the spring 43.

[Lost Motion Springs 50]

The lost motion springs 50 shown in FIGS. 6A, 6B, etc. are members that bias the input arm 20 against the cam 10 when in the uncoupled state. The lost motion springs 50 are comprised of the right lost motion spring 50 and the left lost motion spring 50. As shown in FIGS. 5A, 5B, etc., each lost motion spring 50 includes the coil portion 51, the extended portion 52, and a second extended portion 53.

The coil portion 51 of each lost motion spring 50 is a portion in the shape of a coil and is fitted on a corresponding one of the projections 38 in the storage portions 36. As shown in FIG. 1 etc., the extended portion 52 of each lost motion spring 50 extends from the coil portion 51 through a corresponding one of the insertion holes 37 into a corresponding one of the inter-arm clearances G when in a base circle phase. A front end of the extended portion 52 of each lost motion spring 50 is inserted through and engaged with a corresponding one of the spring retaining portions 26 (end face grooves 26A) in the end faces of the roller pin 25. The second extended portion 53 of each lost motion spring 50 extends obliquely upward to the rear from the coil portion 51, and a rear end of the second extended portion 53 is retained by a retaining portion 36*a* formed in the upper surface of a corresponding one of the storage portions 36.

Accordingly, when in the uncoupled state, a force applied from the spring retaining portions 26 to the front ends of the extended portions 52 is transmitted to the retaining portions 36*a* through the coil portions 51 and the second extended portions 53. At this time, the coil portions 51 are deformed, generating an elastic force. Due to this elastic force, the extended portions 52 press the upper inner side surfaces of the spring retaining portions 26 (end face grooves 26A) upward, thereby biasing the roller 28 against the cam 10 via the roller pin 25. As shown in FIG. 4B, when in the uncoupled state, as the input arm 20 swings relative to the output arm 30 about the shaft members 21 located on the front side, the extended portions 52 of the lost motion springs 50 swing relative to the output arm 30 about the coil portions 51 located on the rear side accordingly. The longitudinal directions of the spring retaining portions 26 (end face grooves 26A) are thus shifted so as to align with the longitudinal directions of the extended portions 52 of the lost motion springs 50. The roller pin 25 thus rotates relative to the input arm 20.

The first embodiment has the following advantageous effects.

Figure 12B:
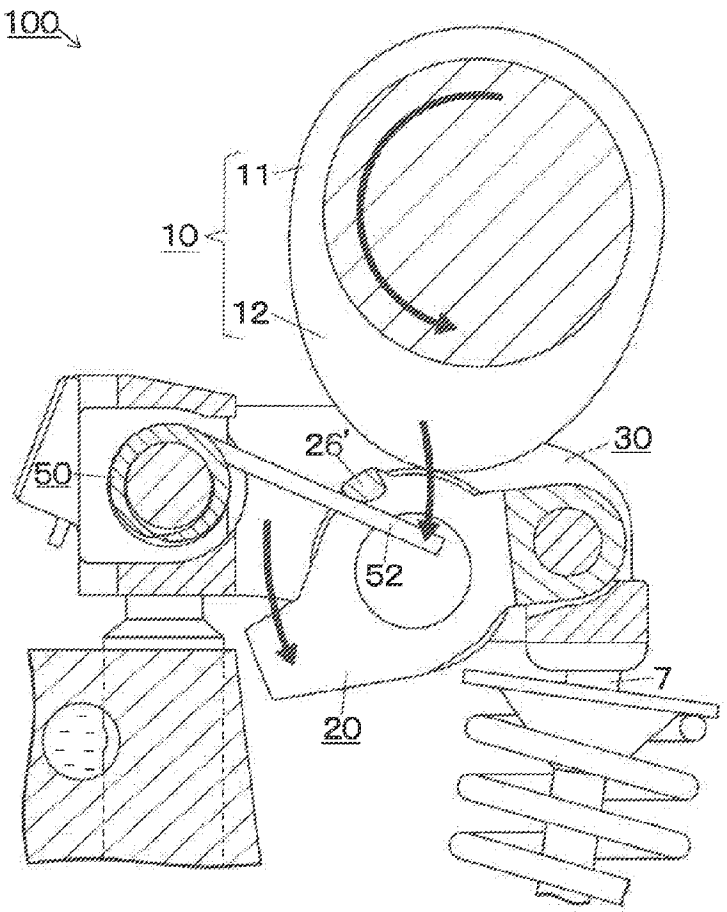
FIG. 12B is a side sectional view showing a nose phase of the variable valve mechanism of the comparative example in the uncoupled state.
Figure 12A:
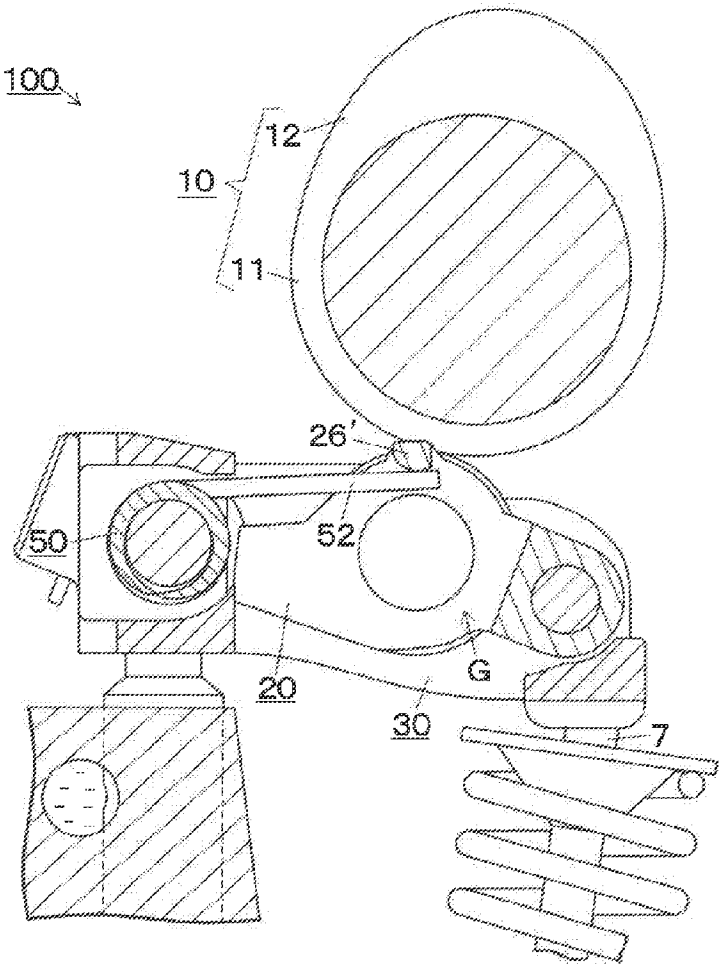
FIG. 12A is a side sectional view showing a base circle phase of a variable valve mechanism of a comparative example in an uncoupled state.
Figure 13A:
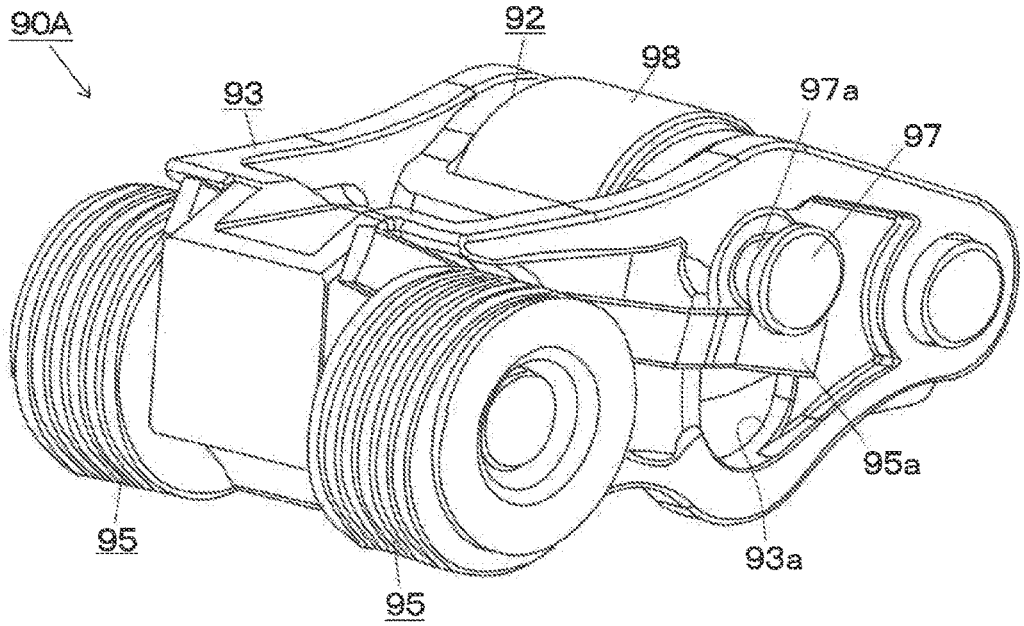
FIG. 13A PRIOR ART
FIG. 13A is a perspective view of a variable valve mechanism of a first conventional example.
Figure 13B:
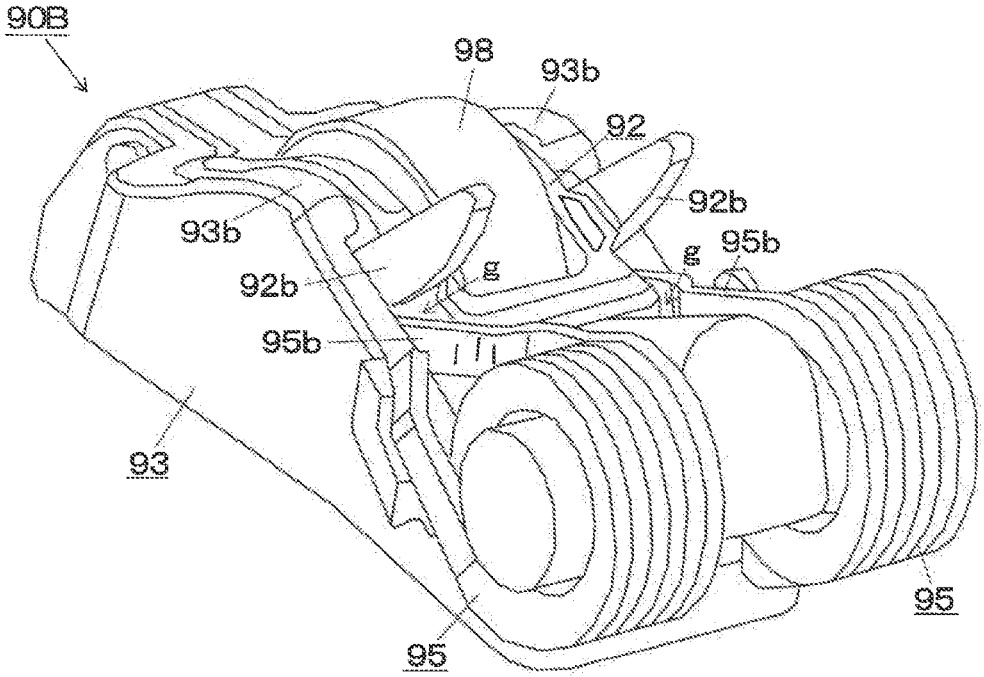
FIG. 13B PRIOR ART
FIG. 13B is a perspective view of a variable valve mechanism of a second conventional example.

(A) In a variable valve mechanism 100 of a comparative example shown in FIGS. 12A and 12B, spring retaining portions 26' are formed in an upper part of the input arm 20. Unlike this variable valve mechanism 100 of the comparative example, the spring retaining portions 26 are formed in the roller pin 25 as shown in FIGS. 4A, 4B, etc. Accordingly, even though the slippers 32 are formed in the upper part of the output arm 30 so as to project into the inter-arm clearances G, the slippers 32 do not contact the spring retaining portions 26. This increases design flexibility of the output arm 30.

(B) The spring retaining portions 26 are formed in the roller pin 25 rather than in the input arm 20. This simplifies the shape of the input arm 20 and increases design flexibility in terms of the shape of the input arm 20. Due to the simplified shape of the input arm 20, reduction in manufacturing cost is also expected.

(C) The spring retaining portions 26 are formed in the ends 25*e* of the roller pin 25 rather than in the upper part of the input arm 20 where only limited space is available. This increases space available for the spring retaining portions 26 and thus increases design flexibility in terms of the positions, forms, etc. of the spring retaining portions 26 and the lost motion springs 50. Due to the increased design flexibility in terms of the forms, the spring retaining portions 26 can be the end face grooves 26A as shown in the first embodiment. In fact, the use of the end face grooves 26A as the spring retaining portions 26 increases the contact area between the lost motion spring 50 and the spring retaining portion 26 (end face groove 26A). This reduces the surface pressure between the lost motion spring 50 and the spring retaining portion 26, whereby wear therebetween can be reduced.

(D) Since the spring retaining portions 26 are formed in the roller pin 25, the biasing force of the lost motion springs 50 is transmitted directly to the roller pin 25 without via the input arm 20. This reduces wear between the input arm 20 and the roller pin 25.

(E) When in the uncoupled state, the longitudinal directions of the spring retaining portions 26 (end face grooves 26A) are shifted so as to align with the longitudinal directions of the extended portions 52 of the lost motion springs 50, and the roller pin 25 thus rotates relative to the input arm 20. As the extended portions 52 swing, the spring retaining portions 26 (end face grooves 26A) are thus turned accordingly so as to extend in an appropriate direction, and wear between the extended portion 52 and the spring retaining portion 26 is reduced.

As described above, the biasing force of the lost motion springs 50 is not applied between the input arm 20 and the roller pin 25. Accordingly, even when the roller pin 25 rotates relative to the input arm 20, friction is not much generated between the input arm 20 and the roller pin 25.

[Second Embodiment]

Figure 9A:
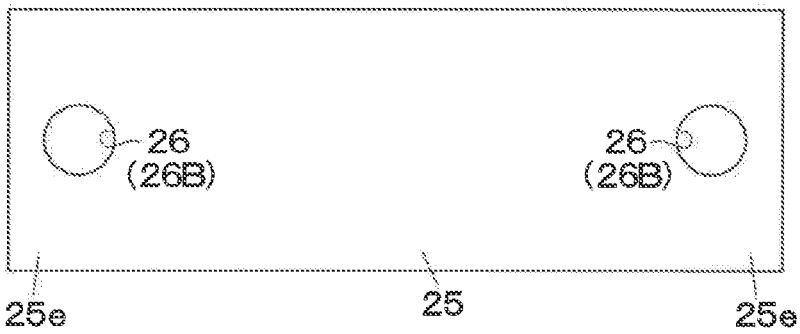
FIG. 9A is a front view of a roller pin of the variable valve mechanism of the second embodiment.
Figure 9B:
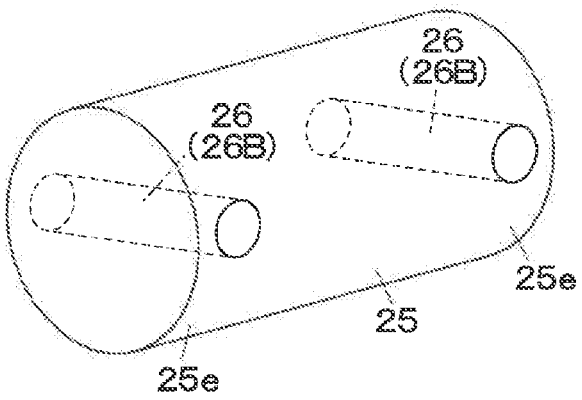
FIG. 9B is a perspective view of the roller pin of the variable valve mechanism of the second embodiment.
Figure 9C:
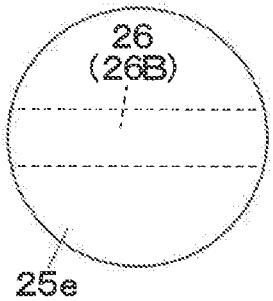
FIG. 9C is a side view of the roller pin of the variable valve mechanism of the second embodiment.
Figure 10B:
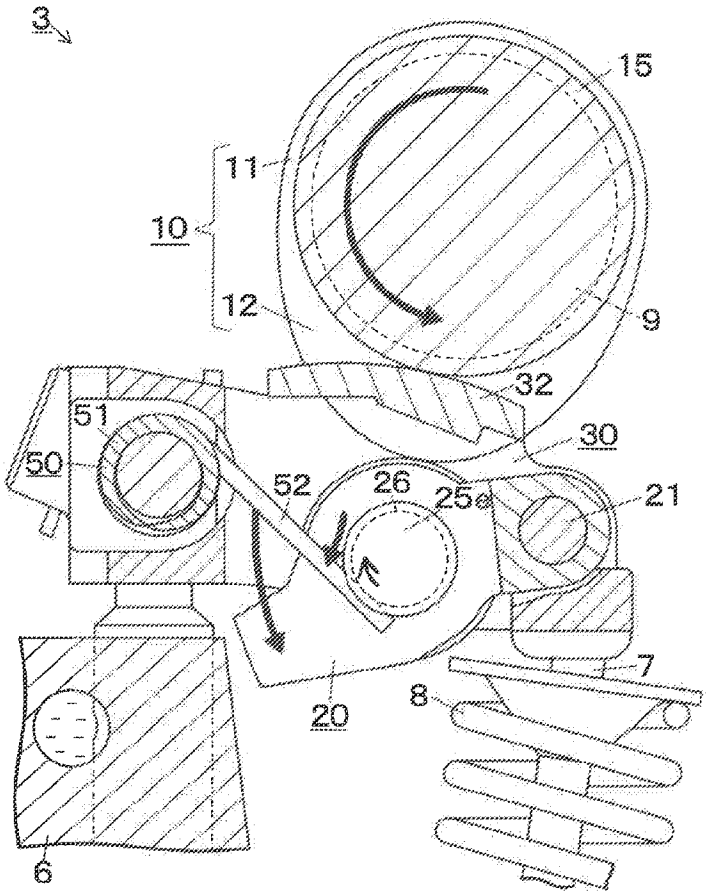
FIG. 10B is a side sectional view showing a nose phase of the variable valve mechanism of the third embodiment in the uncoupled state.
Figure 10A:
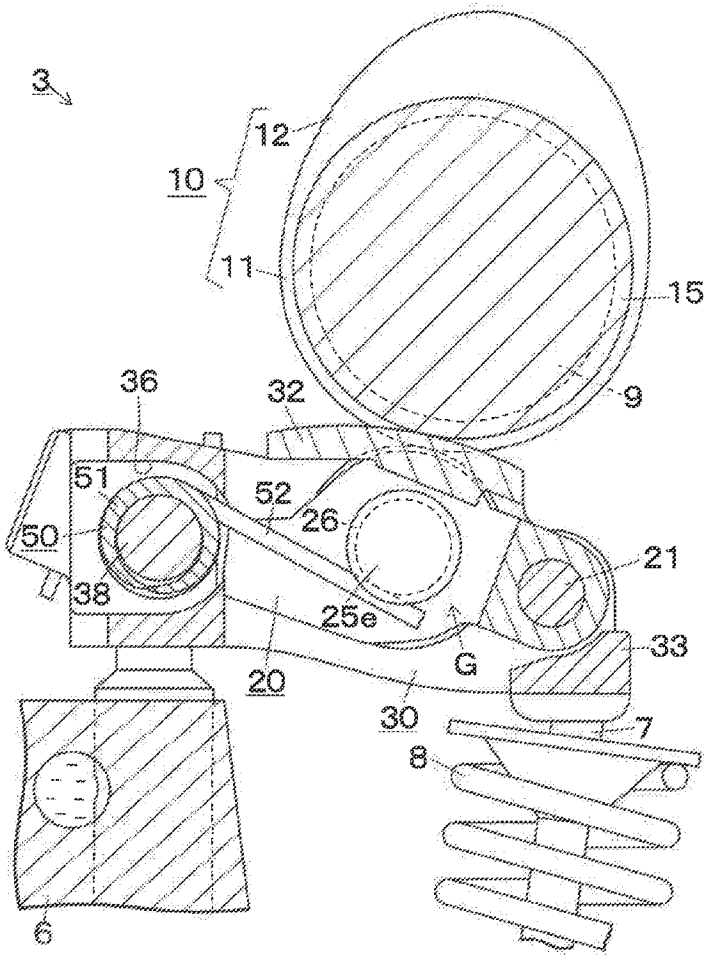
FIG. 10A is a side sectional view showing a base circle phase of a variable valve mechanism of a third embodiment in an uncoupled state.
Figure 11A:
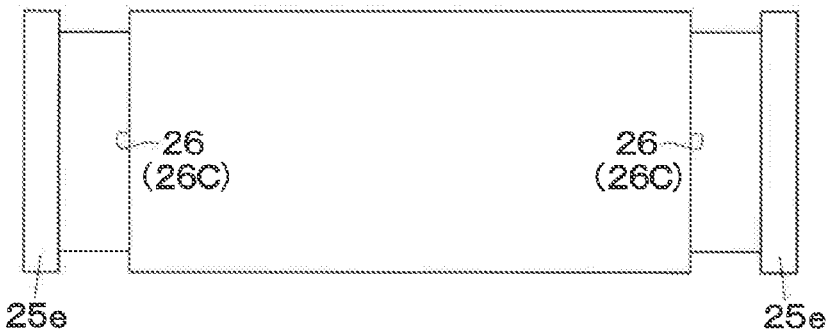
FIG. 11A is a front view of a roller pin of the variable valve mechanism of the third embodiment.
Figure 11B:
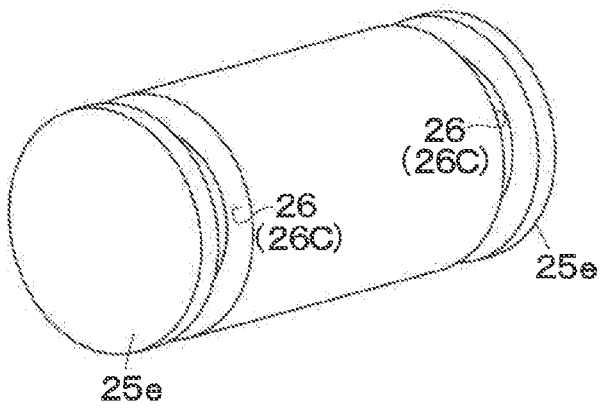
FIG. 11B is a perspective view of the roller pin of the variable valve mechanism of the third embodiment.
Figure 11C:
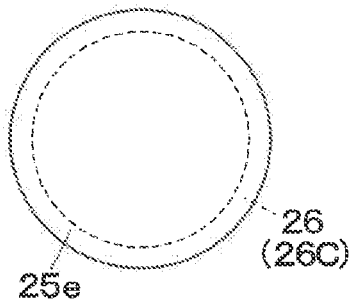
FIG. 11C is a side view of the roller pin of the variable valve mechanism of the third embodiment.

A variable valve mechanism 2 of a second embodiment shown in FIGS. 8A to 9C is different from the variable valve mechanism 1 of the first embodiment in the following points and is otherwise similar to the variable valve mechanism 1 of the first embodiment. As shown in FIGS. 9A to 9C etc., the spring retaining portions 26 are through holes 26B formed in the ends 25*e* of the roller pin 25 so as to extend through the roller pin 25 in the radial direction. The through holes 26B have a circular section.

The second embodiment has advantageous effects similar to those of the first embodiment. In particular, in the case where the extended portions 52 of the lost motion springs 50 have a circular section, the curved surfaces of the extended portions 52 contact the curved surfaces of the spring retaining portions 26 (through holes 26B). Accordingly, the contact area between the lost motion spring 50 and the spring retaining portion 26 (through hole 26B) is increased and the surface pressure therebetween is reduced as compared to the first embodiment (the end face grooves 26A). The above effect (C) is thus enhanced.

[Third Embodiment]

A variable valve mechanism 3 of a third embodiment shown in FIGS. 10A to 11C is different from the variable valve mechanism 1 of the first embodiment in the following points and is otherwise similar to the variable valve mechanism 1 of the first embodiment. The spring retaining portions 26 are outer peripheral grooves 26C formed in an outer peripheral surface of the roller pin 25 so as to extend in the circumferential direction. When in the uncoupled state, as the input arm 20 swings, the spring retaining portions 26 roll on the extended portions 52 of the lost motion springs 50 accordingly, whereby the roller pin 25 rotates relative to the input arm 20.

The third embodiment has the above effects (A) to (D) and the following effect (E').

(E') When in the uncoupled state, the spring retaining portions 26 roll on the extended portions 52 of the lost motion springs 50. This reduces wear between the extended portion 52 and the spring retaining portion 26.

For example, the above embodiments may be modified as follows.

[First Modification] The second cams 15 (no-lift cams) may be low speed cams having a second nose that is lower than the nose 12 of the cam 10.

[Second Modification] The second cams 15 may be eliminated so that the slippers 32 are in sliding contact with the camshaft 9.

[Third Modification] The spring retaining portions 26 may be in the form of projections.

REFERENCE SIGNS LIST

1 Variable valve mechanism (first embodiment)
2 Variable valve mechanism (second embodiment)
3 Variable valve mechanism (third embodiment)
7 Valve
9 Camshaft
10 Cam
11 Base circle of Cam
15 Second cam
20 Input arm
25 Roller pin
25*e* End of Roller pin
26 Spring retaining portion
26A End face groove
26B Through hole
26C Outer peripheral groove
28 Roller
30 Output arm
32 Slipper
37 Insertion hole
37*a* Connecting portion
40 Switch device
50 Lost motion spring
52 Extended portion of Lost motion spring
G Inter-arm clearance

The invention claimed is:

1. A variable valve mechanism of an internal combustion engine, comprising:

an input arm that axially supports a roller, which is pressed by a cam, via a roller pin;

an output arm that drives a valve when swinging;

a switch device that switches the variable valve mechanism between a coupled state where the input arm and the output arm are coupled to swing together and an uncoupled state where the input arm and the output arm are uncoupled from each other; and a lost motion spring that presses a spring retaining portion, which swings with the input arm, to bias the roller against the cam when in the uncoupled state, wherein when in a base circle phase during which a base circle of the cam functions, there is an inter-arm clearance between the input arm and the output arm, and the lost motion spring includes an extended portion that extends in the inter-arm clearance and that presses the spring retaining portion, and when in the base circle phase, an end of the roller pin projects from the input arm into the inter-arm clearance by such a length that the end is accommodated in the inter-arm clearance and that allows the spring retaining portion to be formed in the end, and the spring retaining portion is formed in the end of the roller pin.

2. The variable valve mechanism of the internal combustion engine according to claim 1, wherein the roller pin is attached to the input arm so that the roller pin is rotatable relative to the input arm, and when in the uncoupled state, as the input arm swings relative to the output arm, the roller pin rotates relative to the input arm accordingly.

3. The variable valve mechanism of the internal combustion engine according to claim 2, wherein the spring retaining portion is long in a radial direction of the roller pin, and when in the uncoupled state, as the input arm swings relative to the output arm, a longitudinal direction of the spring retaining portion is shifted accordingly so as to align with a longitudinal direction of the extended portion of the lost motion spring, whereby the roller pin rotates relative to the input arm.

4. The variable valve mechanism of the internal combustion engine according to claim 2, wherein the spring retaining portion is long in a circumferential direction of the roller pin, and when in the uncoupled state, as the input arm swings relative to the output arm, the spring retaining portion rolls on the extended portion of the lost motion spring accordingly, whereby the roller pin rotates relative to the input arm.

5. The variable valve mechanism of the internal combustion engine according to claim 3, wherein the spring retaining portion is an end face groove formed in an end face of the roller pin so as to extend in the radial direction.

6. The variable valve mechanism of the internal combustion engine according to claim 3, wherein the spring retaining portion is a through hole formed in the end of the roller pin so as to extend through the roller pin in the radial direction.

7. The variable valve mechanism of the internal combustion engine according to claim 4, wherein the spring retaining portion is an outer peripheral groove formed in an outer peripheral surface of the end of the roller pin so as to extend in the circumferential direction.

8. The variable valve mechanism of the internal combustion engine according to claim 1, wherein the cam is disposed on a camshaft so as to project from the camshaft, and the output arm has a slipper that is in sliding contact with the camshaft or a second cam disposed on the camshaft so as to project from the camshaft.

9. The variable valve mechanism of the internal combustion engine according to claim 1, wherein an insertion hole extending from a position outside the inter-arm clearance to a position in the inter-arm clearance is formed so as to extend through an intermediate portion in a vertical direction of the output arm with a connecting portion remaining on both sides in the vertical direction of the insertion hole, and the extended portion of the lost motion spring is inserted through the insertion hole.

10. The variable valve mechanism of the internal combustion engine according to claim 1, wherein the input arm is an inner arm, and the output arm is an outer arm including two side plate portions disposed on right and left sides relative to the input arm such that one side plate portion is located on each side relative to the input arm.

11. The variable valve mechanism of the internal combustion engine according to claim 10, wherein the output arm includes a base portion connecting rear ends of the right and left side plate portions and is swingably supported at the base portion.

12. The variable valve mechanism of the internal combustion engine according to claim 11, wherein the lost motion spring includes a coil portion, the extended portion, and a second extended portion, and a storage portion is formed so as to extend in both the base portion and at least one of the side plate portions, a projection and a retaining portion are formed in the storage portion, the coil portion is fitted on the projection, and the second extended portion is retained by the retaining portion.

* * * * *